United States Patent [19]

Miller

[11] 4,344,245

[45] Aug. 17, 1982

[54] REVOLVER CRANE BARREL EXTENDER AND ALIGNMENT TOOL

[76] Inventor: Fred R. Miller, 2620 E. 32nd St., Davenport, Iowa 52807

[21] Appl. No.: 163,039

[22] Filed: Jun. 26, 1980

[51] Int. Cl.[3] ..... F41C 27/00

[52] U.S. Cl. ..... 42/1 R; 42/59; 42/90

[58] Field of Search ..... 42/59, 62, 90, 1 R; 30/94; 29/406, 402.05, 402.06, 402.19; 72/74, 112, 367, 377, 462–464, 468

[56] References Cited

U.S. PATENT DOCUMENTS 517,172 3/1894 Wesson ..... 42/62

1,256,556 2/1918 Hedges ..... 30/94

*Primary Examiner*—Charles T. Jordan

*Attorney, Agent, or Firm*—Nathan Edelberg; Robert P. Gibson; Robert O. Richardson

[57] ABSTRACT

A tool for extending the barrel of a revolver crane and for checking the alignment of the crane barrel and cylinder locking aperture in a revolver frame. The crane barrel is inserted over an alignment stud and an adjustable stylus is threaded into contact with the crane barrel near its end. Rotation of the crane barrel causes a groove to be worn on the outer surface of the crane barrel and thus cause the barrel to elongate to its desired length. Additionally, the alignment stud may be used to align the crane barrel to the revolver cylinder locking aperture.

7 Claims, 7 Drawing Figures

REVOLVER CRANE BARREL EXTENDER AND ALIGNMENT TOOL

GOVERNMENT RIGHTS

The invention described herein may be manufactured and/or used by or for the Government for governmental purposes without the payment of any royalty thereon.

BACKGROUND OF THE INVENTION

Revolvers develop some end play in the cylinder after prolonged usage. This condition, known as end shake cylinder, results from the constant impact imparted to the cylinder by the firing pin during firing. End shake cylinder is an undesirable condition which can cause misfires if the play becomes excessive.

Typically, the cylinder of a revolver rotates on a forked support member known as a crane or yoke. The crane has two legs, called the barrel and the stud, which are connected by a body portion. The stud fits into an aperture in the weapon frame and the crane barrel supports the cylinder. It is the length of the crane barrel which determines the amount of end play in the cylinder. With wear the crane barrel length becomes shorter, increasing the end play. The length of the barrel must be very precise to assure free rotation of the cylinder without permitting excessive end play. Therefore, the crane is not a part which is interchangeable between weapons. Each crane must be precisely fit in length to the particular weapon frame and cylinder with which it will be used. For this reason, it is not possible to simply obtain and install a new crane as end shake develops.

In the past it has been necessary to return the weapon to the manufacturer for repair, or to have the repair performed by an experienced pistolsmith. This is a difficult repair procedure and can easily be worsened in inexperienced hands. The present repair procedure requires removal of the crane from the weapon and insertion of a steel rod or liner into the bore of the crane barrel. The crane is then placed against a steel block and peened about its circumference near the end of the crane barrel. The peening causes deformation of the metal, resulting in expansion of the crane barrel length. The barrel of the crane can then be carefully filed back to obtain the correct fit once again. Frequent reassembly is required to check for proper fit. If too much metal is removed, or if the crane barrel end is not filed perfectly square, the repair is ruined, necessitating factory repairs.

An alternate method of repair involves inserting small hardened washers into the cylinder bore to remove the end shake. Many times the washers become imbedded in the cylinder, making removal impossible and causing binding in the rotation of the cylinder. Therefore, this method of repair is often unsatisfactory.

SUMMARY OF THE PRESENT INVENTION

The present invention relates to a tool which allows end shake cylinder to be easily repaired without the use of washers or peening and filing. The tool consists of a metal block which has a counterbored hole through it. The counterbore is of a diameter just large enough to accept the crane barrel. The remaining portion of the hole through the tool block is of a diameter equal to the bore of the crane barrel. This portion of the hole supports an alignment stud which is secured by means of a set screw in the tool block. An adjustable stylus is threaded into the tool block perpendicular to the alignment stud and positioned approximately ⅛ of an inch from the bottom of the counterbore.

In use, the crane barrel of the worn crane is positioned over the alignment stud and bottomed in the counterbore. The stylus is then tightened against the end of the crane barrel and the crane is rotated by hand. The stylus engraves a small groove around the crane barrel, causing a slight stretching of the metal to elongate the crane barrel. The crane is then reassembled to the weapon to check for fit. This process is repeated until the proper fit is obtained.

This tool greatly reduces the degree of expertise required to perform end shake repairs. The crane barrel is uniformly stretched around its circumference, therefore, no filing or machining is required to square up the crane barrel end.

DETAILED DESCRIPTION OF ILLUSTRATIVE EMBODIMENTS

Figure 1:
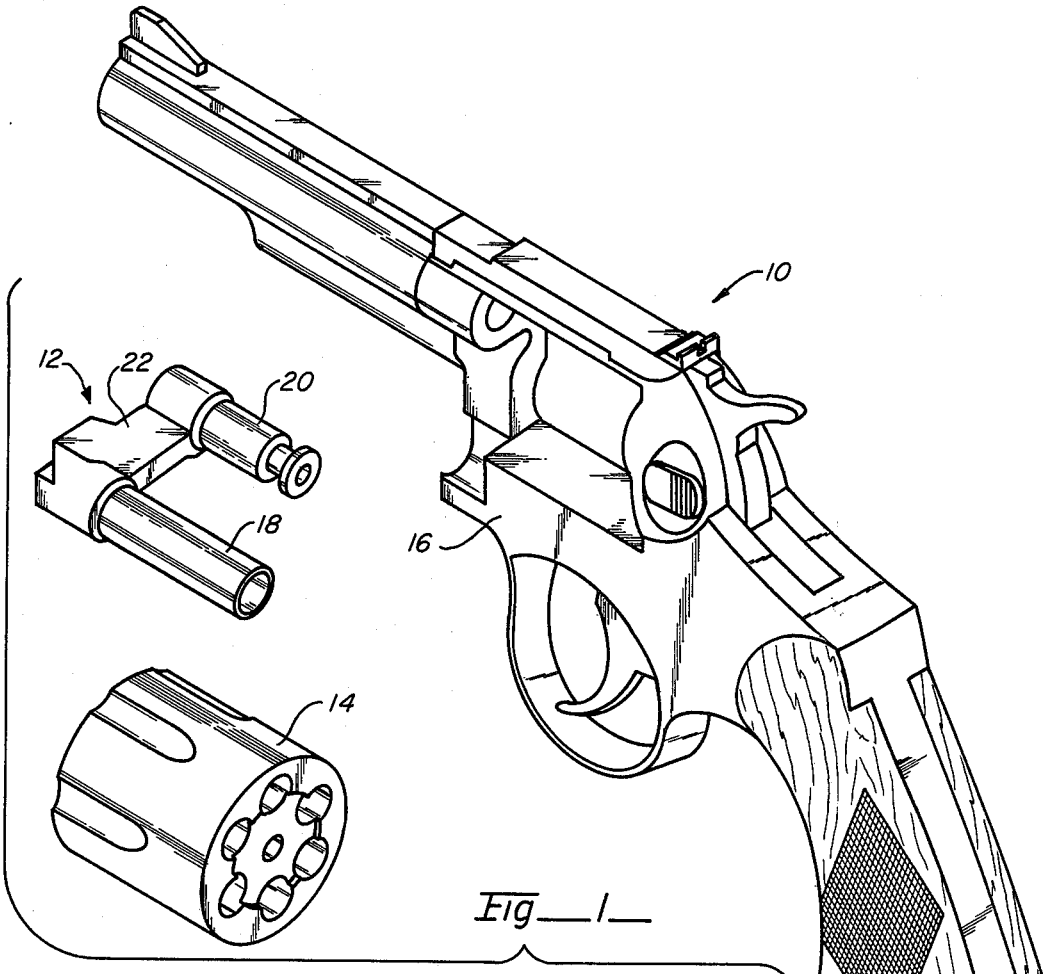
FIG. 1 is a perspective view of a revolver showing the crane and cylinder removed.
Figure 2:
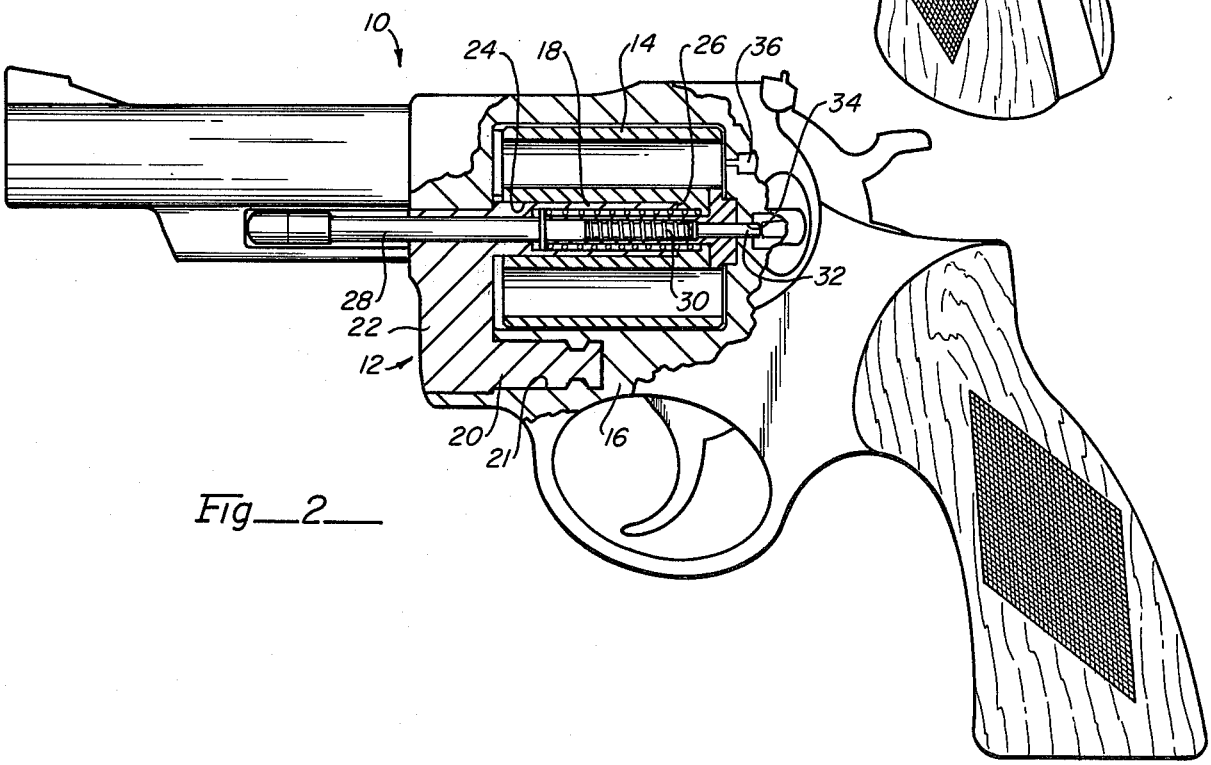
FIG. 2 is a side elevational view of the revolver showing the cylinder area in cross section.

Reference is made to FIG. 1 wherein there is shown a typical revolver 10. The crane 12 and cylinder 14 are removed from the revolver frame 16 to more clearly illustrate the relationship of these components. The crane 12 has two legs, the crane barrel 18 and the stud 20, which are connected by the body 22. As shown in FIG. 2, the cylinder 14 is supported by the crane barrel 18 of the crane 12. The crane barrel 18 is received in bore 24 in the cylinder 14 and abuts shoulder 26. It can be seen that the length of the crane barrel 18 determines the amount of axial play or cylinder end shake. Stud 20 is received in aperture 21 in frame 16 to mount the crane/cylinder assembly to the revolver 10. Ejector rod 28 supports helical spring 30 which biases cylinder locking pin 32 into aperture 34 in the weapon frame 16 to lock the cylinder closed for firing.

Each time the weapon is fired a substantial load is imparted to the barrel of the crane. In addition, the crane is subject to wear as the cylinder rotates. After prolonged useage the end of the crane barrel 18 becomes worn and thus becomes shorter. This allows the cylinder to move forwardly with respect to the revolver frame 16. As a result, the firing pin 36 can no longer strike the cartridge primer (not shown) with enough force to detonate the cartridge. To correct this condition, it is necessary to replace the crane or elongate the crane barrel 18. Replacement of the crane requires returning the weapon to the factory for proper fitting of worn parts. As previously stated, the present repair methods are difficult to perform and often give unsatisfactory results. The present invention provides a simple reliable method of performing cylinder end shake repairs.

Figure 3:
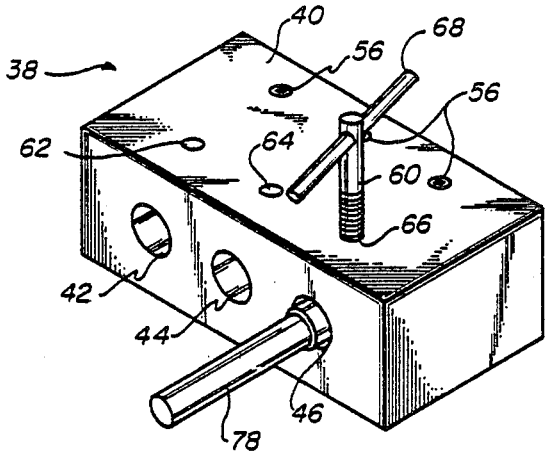
FIG. 3 is a perspective view of the crane extender tool.
Figure 4:
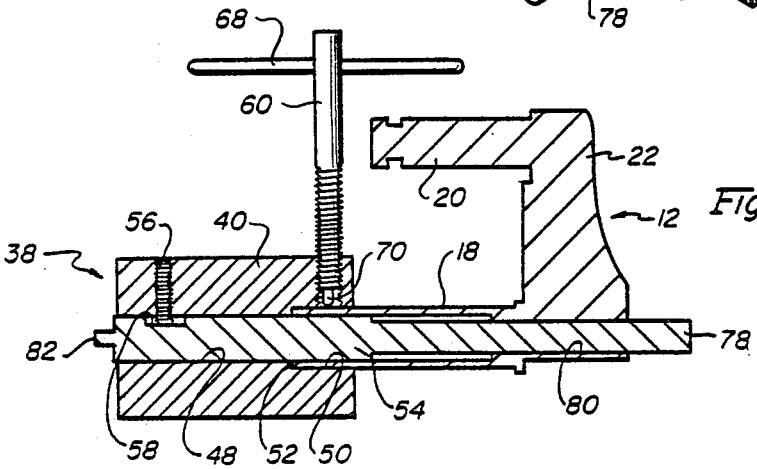
FIG. 4 is a sectional view of the crane extender tool with a crane in position for repair.
Figure 5:
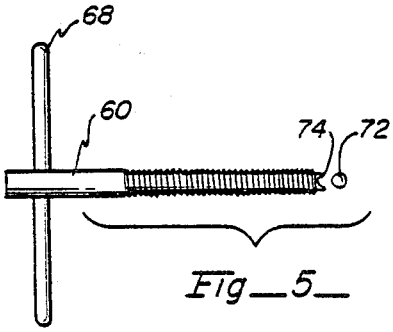
FIG. 5 is a side elevational view of an alternate method of construction of the stylus.
Figure 6:
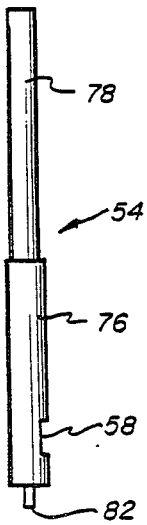
FIG. 6 is a side elevational view of a typical alignment stud.

Referring now to FIG. 3, there is shown a crane barrel extending tool 38 in accordance with the present invention. The tool includes a body 40 having a plurality of holes 42, 44, 46 bored through it. As shown in FIG. 4, each hole 42, 44, 46 has a small diameter section 48 and a large diameter section 50. A shoulder 52 is formed where the two diameters meet. The small diameter section 48 of each hole 42, 44, 46 is sized to match the diameter of the bore of the crane barrel being repaired. An alignment stud 54 is supported by the small diameter section 48 of the extending tool 38 and is secured by means of a set screw 56 which engages a flat 58 on the stud 54. A different size alignment stud, such as that shown in FIG. 6, is used with each of the different holes 42, 44, 46 for repairing various crane barrel sizes. The large section of holes 42, 44, 46 is sized to accept varying sizes of crane barrels as shown in FIG. 4. An adjustable stylus 60 is threaded into the appropriate aperture 62, 64, 66. A T-handle 68 is provided to enable the user to adequately tighten the stylus when in use. FIGS. 4 and 5 show alternate methods of stylus construction. In FIG. 4 a one piece rounded tip 70 is shown whereas FIG. 5 shows a separate ball tip 72. Both tips preferably are hardened to reduce wear. The tip 72 fits into a socket 74 in the end of the stylus 60. The ball tip 72 is staked in the socket 74 to retain it while still allowing it to rotate. This method of construction provides longer stylus life and smoother operation of the tool.

In use, the appropriate hole 42, 44, 46 is selected depending on the size of the crane barrel being repaired. In addition, the proper alignment stud is selected and secured in the tool by set screw 56. The stylus is then threaded into the corresponding aperture 62, 64, 66. The crane is then disassembled from the revolver and positioned over the alignment stud 54 as shown in FIG. 4. Shoulder 52 limits the depth to which the crane may be inserted into the tool. The stylus 60 is then tightened onto the crane barrel 18. The crane may then be rotated on the alignment stud 54 which engraves a groove near the end of the crane barrel 18, thus extending its length. The crane is then reassembled to the revolver to check for fit. This process may be repeated as often as necessary until the end shake has been removed, thus restoring the revolver to proper operation.

Figure 7:
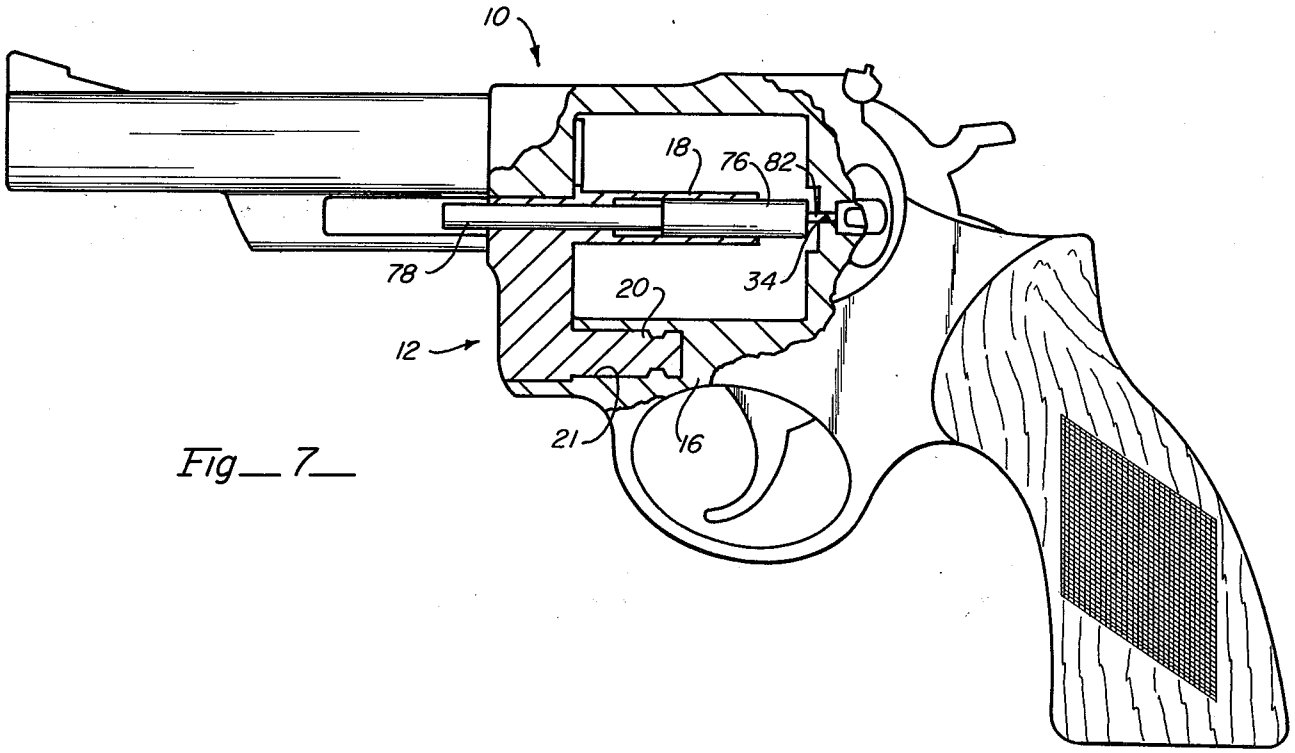
FIG. 7 is a side elevational view of the revolver similar to FIG. 2 showing an alignment stud positioned in the bore of the crane barrel.

The alignment studs 54 are designed to serve a second purpose. To prevent binding of the cylinder 14, the center of the crane barrel 18 must exactly match the center of the cylinder locking pin aperture 34. The alignment stud 54 may be used to measure the alignment of these centers. As shown in FIG. 6, the alignment stud includes a large diameter section 76 and a small diameter section 78. As previously stated, the large diameter section 76 of the alignment stud 54 matches the bore size of the crane barrel 18. The small diameter section 78 of the alignment stud 54 matches the diameter of the ejector rod 28 (FIG. 2), and is a sliding fit in the reduced bore section 80 (FIG. 4) of the crane barrel 18. The opposite end of the alignment stud 54 has a protruding concentric tip 82. To check the alignment of the crane barrel center line and the cylinder locking pin aperture 34, the ejector rod 28, cylinder locking pin 34, cylinder 14, and crane 12 are removed from the pistol (see FIGS. 2 and 7). The crane is then assembled to the revolver with the alignment stud 54 positioned in the crane barrel bore as shown in FIG. 7. The reduced diameter section 78 of the alignment stud 54 projects from the front of the crane 12 similar to the ejector rod 28. By pushing on the protruding part of the alignment stud, it can be seen whether the tip 82 on the opposite end of stud 54 mates with the cylinder locking aperture 34. Necessary adjustments are made to bend, deflect, or distort the barrel 18 into proper alignment as evidenced by the stud tip 82 mating with the locking aperture 34.

The invention in its broader aspects is not limited to the specific combinations, improvements, and instrumentalities described, but departures may be made therefrom within the scope of the accompanying claims without departing from the principles of the invention and without sacrificing its chief advantages.

What is claimed is:

1. A revolver crane barrel extender and alignment tool comprising:
   a tool body 40,
   an alignment stud 54, and
   a stylus 60,
   said body having an opening of a first diameter to receive said alignment stud,
   said stud being inserted therein,
   said stud being of such size as to fit within a crane barrel to be extended,
   said body opening having a larger diameter section into which said crane barrel may be inserted when mounted onto said stud,
   said body having a stylus receiving threaded aperture communicating with said larger diameter section,
   said stylus upon rotation in said aperture engaging the outer surface of said barrel, whereby rotation of said crane barrel about said stud causes said stylus to wear a groove about the outer barrel surface, thus causing said barrel to elongate.

2. A revolver crane barrel extender and alignment tool as set forth in claim 1 including a shoulder in said body opening formed by the intersection of said first diameter opening and said larger diameter section,
   said shoulder serving to limit the depth to which said crane barrel may be inserted into said tool body.

3. A revolver crane barrel extender and alignment tool as set forth in claim 1 having means to prevent rotation of said alignment stud,
   said means comprising a flat surface on said alignment stud,
   a set screw threaded into said tool body engageable with said flat.

4. A revolver crane barrel extender and alignment tool as set forth in claim 1 wherein said body has multiple openings and multiple studs of various sizes are included to accommodate crane barrels of various diameters.

5. A revolver crane barrel extender and alignment tool as in claim 1, said stylus having a threaded shaft engageable with said body stylus receiving aperture, said stylus having a hardened tip at one end thereof and handle means at the other end thereof for manually rotating said shaft in said aperture.

6. A revolver crane barrel extender and alignment tool as in claim 5 wherein said tip is a ball tip staked in a socket in the end of said stylus.

7. A revolver crane barrel extender and alignment tool as in claim 1 wherein said stud has a protruding concentric tip on one end thereof,
   a revolver having a cylinder locking aperture and a crane,
   said stud tip being engageable with said locking aperture when said stud is passed through said crane barrel when said crane is positioned on said revolver and said crane barrel is in proper alignment.

* * * * *